US009108437B2

(12) United States Patent
Hirose et al.

(10) Patent No.: US 9,108,437 B2
(45) **Date of Patent: *Aug. 18, 2015**

(54) PRINTING APPARATUS, TREATMENT OBJECT MODIFYING APPARATUS, PRINTING SYSTEM, AND PRINTED MATERIAL MANUFACTURING METHOD

(71) Applicant: RICOH COMPANY, LTD., Ohta-ku (JP)

(72) Inventors: Yohji Hirose, Ibaraki (JP); Masakazu Yoshida, Kanagawa (JP); Toshitaka Osanai, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/104,383

(22) Filed: Dec. 12, 2013

(65) Prior Publication Data

US 2014/0160197 A1 Jun. 12, 2014

(30) Foreign Application Priority Data

Dec. 12, 2012 (JP) ..... 2012-271716
Oct. 17, 2013 (JP) ..... 2013-216724

(51) Int. Cl.

| | |
|---|---|
| ***B41J 29/393*** | (2006.01) |
| ***B41J 11/00*** | (2006.01) |
| ***B41M 5/00*** | (2006.01) |
| ***H05H 1/24*** | (2006.01) |

(52) U.S. Cl.

CPC ..... *B41J 11/0015* (2013.01); *B41M 5/0011* (2013.01); *H05H 1/2406* (2013.01); *B41M 5/0041* (2013.01); *B41M 5/0047* (2013.01); *B41M 5/0064* (2013.01); *H05H 2001/2412* (2013.01); *H05H 2001/2431* (2013.01)

(58) Field of Classification Search

CPC .. B41J 2/17566; B41J 11/0095; B41J 2/2146; B41J 11/002; B41J 2/0458; B41J 2/14153

See application file for complete search history.

(56) References Cited

U.S. PATENT DOCUMENTS

| | | | | |
|---|---|---|---|---|
| 7,661,808 | B2 * | 2/2010 | Nakajima | 347/102 |
| 8,746,846 | B2 * | 6/2014 | Arakawa | 347/45 |
| 8,967,784 | B2 * | 3/2015 | Ram et al. | 347/101 |
| 2002/0067394 | A1 | 6/2002 | Yoshihiro et al. | |

(Continued)

FOREIGN PATENT DOCUMENTS

| | | |
|---|---|---|
| DE | 10 2009 049 210 A1 | 5/2011 |
| JP | 5-504519 | 7/1993 |
| JP | 2003-211650 | 7/2003 |
| JP | 2007-098232 | 4/2007 |
| JP | 2007-307885 | 11/2007 |
| JP | 2008-207528 | 9/2008 |

(Continued)

OTHER PUBLICATIONS

The Extended European Search Report issued Apr. 4, 2014, in Application No./Patent No. 13196819.0-1701.

*Primary Examiner* — Lamson Nguyen

(74) *Attorney, Agent, or Firm* — Oblon, McClelland, Maier & Neustadt, L.L.P.

(57) ABSTRACT

A printing apparatus includes a plasma treatment unit that performs plasma treatment on a surface of a treatment object to acidify at least the surface of the treatment object, a recording unit that performs an inkjet recording process on the surface of the treatment object subjected to the plasma treatment by the plasma treatment unit, and a control unit that adjusts plasma energy for the plasma treatment according to a type of an ink used in the inkjet recording process.

10 Claims, 16 Drawing Sheets

(56) References Cited

U.S. PATENT DOCUMENTS

| | | | |
|---|---|---|---|
| 2004/0055698 | A1 | 3/2004 | Tran et al. |
| 2007/0106962 | A1 | 5/2007 | Sakakibara et al. |
| 2009/0290007 | A1 | 11/2009 | Saitoh et al. |

FOREIGN PATENT DOCUMENTS

| | | |
|---|---|---|
| JP | 2009-279796 | 12/2009 |
| JP | 2012-081608 | 4/2012 |
| WO | WO 92/05957 | 4/1992 |

* cited by examiner

FIG.17

| RESOLUTION | DOT SIZE | SIZE OF DROPLET [pl] | PLASMA ENERGY BASED ON SHEET TYPE AND EMPLOYED INK [J/cm$^2$] | | | | | | |
|---|---|---|---|---|---|---|---|---|---|
| | | | PLAIN PAPER A | | | PLAIN PAPER B | | | ··· |
| | | | YMCK | K | M | YMCK | K | M | ··· |
| 600 dpi | SMALL | 2.5 | 0.08 | 0.05 | 0.05 | 0.1 | 0.07 | 0.07 | ··· |
| | MIDDLE | 6.5 | 0.09 | 0.06 | 0.06 | 0.12 | 0.08 | 0.08 | ··· |
| | LARGE | 15 | 0.09 | 0.06 | 0.06 | 0.12 | 0.08 | 0.08 | ··· |
| 1200 dpi | SMALL | 2 | 0.08 | 0.06 | 0.05 | 0.1 | 0.07 | 0.07 | ··· |
| | MIDDLE | 4 | 0.09 | 0.06 | 0.06 | 0.12 | 0.08 | 0.08 | ··· |
| | LARGE | 6 | 0.11 | 0.07 | 0.07 | 0.14 | 0.09 | 0.09 | ··· |

PRINTING APPARATUS, TREATMENT OBJECT MODIFYING APPARATUS, PRINTING SYSTEM, AND PRINTED MATERIAL MANUFACTURING METHOD

CROSS-REFERENCE TO RELATED APPLICATIONS

The present application claims priority to and incorporates by reference the entire contents of Japanese Patent Application No. 2012-271716 filed in Japan on Dec. 12, 2012 and Japanese Patent Application No. 2013-216724 filed in Japan on Oct. 17, 2013.

BACKGROUND OF THE INVENTION

1. Field of the Invention

The present invention relates to a printing apparatus, a treatment object modifying apparatus, a printing system, and a printed material manufacturing method.

2. Description of the Related Art

In conventional inkjet recording apparatuses, it is difficult to improve throughput for high-speed printing because a shuttle head that moves back and forth in a width direction of a recording medium, such as a sheet of paper or a film, is generally used. Therefore, in recent years, to cope with the high-speed printing, a single-pass system has been proposed, in which a plurality of heads are arranged so as to cover the entire width of the recording medium and enable printing with the heads at once.

However, while the single-pass system is advantageous to increase print speed, a time interval between dropping of one dot and dropping of an adjacent dot is short, and the adjacent dot is dropped before the ink of the previously-dropped dot penetrates into the recording medium. Therefore, coalescence of the adjacent dots (hereinafter, may be referred to as impact interference) occurs, so that beading or bleed may occur with which the image quality is reduced.

Furthermore, if an inkjet printing apparatus prints an image on an impermeable medium or a low-permeable medium, such as a film or a coated paper, adjacent dots move and coalesce together, resulting in an image failure, such as beading or bleed. As a conventional technology to solve the above situations, some methods have been proposed; for example, a method to apply primer to a recording medium in advance to improve cohesiveness and fixability of an ink and a method to use an ultraviolet (UV) curable ink.

However, in the method to apply primer to a printing medium in advance, it is necessary to evaporate and dry moisture of the primer in addition to moisture of the ink. Therefore, a longer drying time or a larger drying device is needed. Furthermore, because the primer is a supply, printing costs increase. Moreover, if a treatment liquid is a highly acidic liquid, irritating odor of the liquid may become a problem. In the method to use the UV curable ink, the cost for the UV curable ink is higher than the cost for an aqueous ink, so that printing costs further increase. Furthermore, the UV curable ink itself initiates a chemical reaction and is cured; therefore, while the weather resistance and the resistance against flaking can be improved, the reaction needs to be controlled with higher accuracy and handling becomes difficult.

SUMMARY OF THE INVENTION

It is an object of the present invention to at least partially solve the problems in the conventional technology.

According to an aspect of the present invention, there is provided a printing apparatus including: a plasma treatment unit that performs plasma treatment on a surface of a treatment object to acidify at least the surface of the treatment object; a recording unit that performs an inkjet recording process on the surface of the treatment object subjected to the plasma treatment by the plasma treatment unit; and a control unit that adjusts plasma energy for the plasma treatment according to a type of an ink used in the inkjet recording process.

According to another aspect of the present invention, there is provided a treatment object modifying apparatus including: a plasma-treatment performing unit that performs plasma treatment on a surface of a treatment object to acidify at least the surface of the treatment object; and a control unit that adjusts plasma energy for the plasma treatment according to a type of an ink applied to the treatment object acidified by the plasma-treatment performing unit.

According to still another aspect of the present invention, there is provided A printed material manufacturing method for manufacturing a printed material with an image formed through an inkjet recording process, the printed material manufacturing method including: performing plasma treatment on a surface of a treatment object to acidify at least the surface of the treatment object; performing an inkjet recording process on the surface of the treatment object subjected to the plasma treatment at the performing the plasma treatment; and adjusting plasma energy used for the plasma treatment according to a type of an ink used at the performing the inkjet recording process.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 17 is a diagram illustrating an example of a table used to specify the size of an ink droplet and plasma energy in the flowchart illustrated in FIG. 16;

DETAILED DESCRIPTION OF THE PREFERRED EMBODIMENTS

Exemplary embodiments of the present invention will be explained in detail below with reference to the accompanying drawings. The embodiments below are described as preferable embodiments of the present invention, and therefore, various technically-preferable limitations are applied. However, the scope of the present invention is not unreasonably limited by the descriptions below. Furthermore, not all of the constituent elements described in the embodiments is necessary to embody the present invention.

In an embodiment described below, to prevent dispersion of ink pigments and aggregate the pigments immediately after ink droplets have dropped on a treatment object (also referred to as a recording medium or a printing medium), the surface of the treatment object is acidified. Plasma treatment will be described below as an example of an acidification method.

Furthermore, in the embodiment, wettability of a surface of a treatment object subjected to the plasma treatment, or aggregability or permeability of the ink pigments due to a reduction of a pH value is controlled according to a type of an ink to be used, in order to improve the circularity of an ink dot (hereinafter, simply referred to as "a dot") and to prevent coalescence of the dots so as to enhance sharpness of the dots or a color gamut. Incidentally, inks of different types mean that each ink has different compositions. The inks of different types also mean that each ink has a different color. Therefore, it becomes possible to solve an image failure, such as beading or bleed, and obtain a printed material on which a high-quality image is formed. Moreover, by reducing and equalizing the thicknesses of the aggregated pigments on the printing medium, it becomes possible to reduce the size of an ink droplet, enabling to reduce ink drying energy and printing costs.

Figure 1:
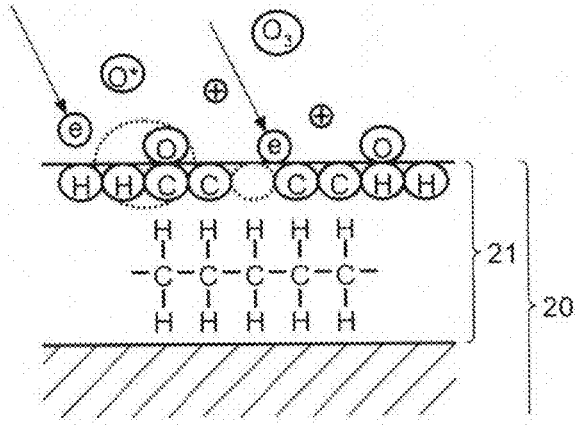
FIG. 1 is a diagram for explaining an example of plasma treatment according to an embodiment of the present invention.

In the plasma treatment as an acidification treatment means (process), a treatment object is exposed to plasma in the atmosphere to cause polymers on the surface of the treatment object to react, so that a hydrophilic functional group is formed. Specifically, as illustrated in FIG. 1, electrons e emitted by a discharge electrode are accelerated in an electric field and cause excitation and ionization of atoms and molecules in the atmosphere. The ionized atoms and molecules also emit electrons, so that the number of high-energy electrons increases and streamer discharge (plasma) occurs. The high-energy electrons produced by the streamer discharge break the polymer bond on the surface of a treatment object 20 (for example, a coated paper) (a coated layer 21 of the coated paper is solidified with calcium carbonate and starch serving as a binder, and the starch has a polymer structure), and are re-combined with oxygen radical O* or ozone $O_3$ in the gas phase. Therefore, a polar functional group, such as a hydroxyl group or a carboxyl group, is formed on the surface of the treatment object 20. Consequently, hydrophilicity or acidification is achieved on the surface of the treatment object 20. If the carboxyl group increases, acidification occurs (a pH value decreases).

To prevent color mixture between dots due to wet spreading and coalescence of adjacent dots on the treatment object caused by an increase in the hydrophilicity, it has been found that it is important to aggregate colorants (for example, pigments or dyes) in the dots, dry vehicles before wet spreading of the vehicles, or cause the vehicles to penetrate into the treatment object before wet spreading of the vehicles. Therefore, in the embodiment, plasma treatment for acidifying the surface of the treatment object is performed as pre-treatment of an inkjet recording process.

The acidification described herein means that the pH value of the surface of the printing medium is decreased to a pH value at which the pigments contained in the ink are aggregated. To decrease the pH value, the density of hydrogen ion H+ in an object is increased. The pigments contained in the ink before coming into contact with the surface of the treatment object are negatively charged, and are dispersed in the vehicles. The viscosity of the ink increases as the pH value of the ink decreases. This is because the pigments that are negatively charged in the vehicles of the ink are more and more electrically neutralized with an increase in the acidity of the ink, and therefore, the pigments are aggregated. Therefore, by decreasing the pH value of the surface of the printing medium so that the pH value of the ink reaches a value corresponding to the necessary viscosity, the viscosity of the ink can be increased. This is because when the ink adheres to the acid surface of the printing medium, the pigments are electrically neutralized with hydrogen ion H+ on the surface of the printing medium and are therefore aggregated. Consequently, it becomes possible to prevent color mixture between adjacent dots and prevent the pigments from penetrating to the deep inside (or even to the back side) of the printing medium. However, to decrease the pH value of the ink to the pH value corresponding to the necessary viscosity, it is necessary to set the pH value of the surface of the printing medium to a value lower than the pH value of the ink corresponding to the necessary viscosity.

A printing apparatus, a treatment object modifying apparatus, a printing system, and a printed material manufacturing method according to the embodiment will be explained in detail below with reference to the drawings.

In the embodiment, an image forming apparatus including ejection heads (recording heads or ink heads) for four colors of black (K), cyan (C), magenta (M), and yellow (Y) is explained. However, the ejection heads are not limited to this example. Specifically, it may be possible to add other ejection heads for colors of green (G) and red (R) or other colors, or it may be possible to provide only an ejection head for black (K). In the description below, K, C, M, and Y represent black, cyan, magenta, and yellow, respectively.

Furthermore, in the embodiment, a continuous roll sheet (hereinafter, referred to as "a roll sheet") is used as a treatment object; however, the present invention is not limited thereto. Any recording medium, such as a cut sheet, may be employed as long as an image can be formed on the recording medium. As a type of the sheet of paper, for example, a plain paper, a high-quality paper, a recycled paper, a thin paper, a thick paper, a coated paper, or the like may be used. Furthermore, an overhead projector (OHP) sheet, a synthetic resin film, a metal thin film, or others on which an image can be formed with an ink or the like may be employed as the treatment object. If the sheet of paper is an impermeable medium or a low-permeable medium, such as a coated paper, the effects of the present invention can be enhanced. The roll sheet may be a continuous sheet (continuous stationary or continuous form paper) that is perforated at regular intervals at which the sheet can be cut off. In this case, a page of the roll sheet means an area between the perforations.

Figure 2:
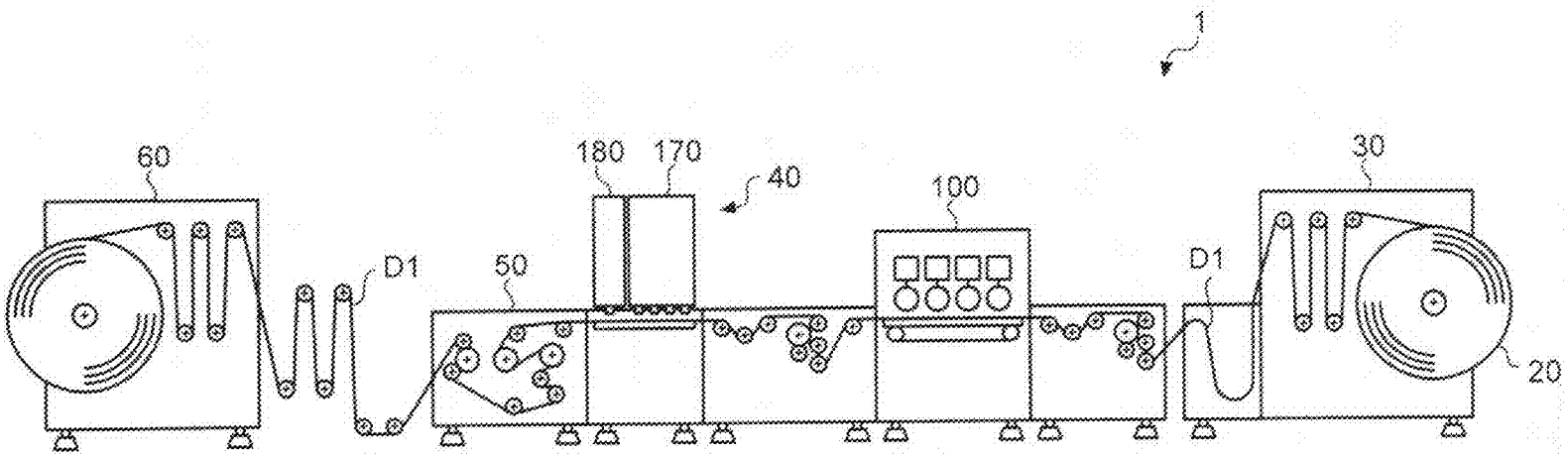
FIG. 2 is a schematic diagram illustrating an overall configuration example of a printing apparatus according to the embodiment.

As illustrated in FIG. 2, a printing apparatus 1 includes a feed unit 30 that feeds (conveys) the treatment object 20 (roll sheet) along a conveying path D1, a plasma treatment apparatus 100 that performs plasma treatment as pre-treatment on the fed treatment object 20, and an image forming unit 40 that forms an image on the surface of the treatment object 20 subjected to the plasma treatment. The image forming unit 40 includes an inkjet head 170 and a pattern reading unit 180. The inkjet head 170 performs an inkjet recording process on the treatment object 20 subjected to the plasma treatment by the plasma treatment apparatus 100, to thereby form an image. The pattern reading unit 180 reads the image formed on the treatment object 20 generated through the inkjet recording process. The image forming unit 40 may also include a post-processing unit that performs post-processing on the treatment object 20 on which the image is formed. Furthermore, the printing apparatus 1 may include a drying unit 50 that dries the treatment object 20 subjected to the post-processing, and a discharging unit 60 that discharges the treatment object 20 on which the image is formed (in some cases, on which the post-processing is also performed). Incidentally, the pattern reading unit 180 may be disposed on the downstream side of the drying unit 50 on the conveying path D1. Moreover, the printing apparatus 1 includes a control unit (not illustrated) that controls operation of each of the units.

According to the embodiment, in the printing apparatus 1 illustrated in FIG. 2, the plasma treatment for acidifying the surface of the treatment object 20 is performed before the inkjet recording process as described above. Atmospheric pressure non-equilibrium plasma treatment using dielectric barrier discharge may be employed as the plasma treatment. The plasma treatment using the atmospheric pressure non-equilibrium plasma is one of preferable plasma treatment methods for a treatment object, such as a recording medium, because the electron temperature is extremely high and the gas temperature is close to the ordinary temperature.

To stably produce the atmospheric pressure non-equilibrium plasma over a wide range, it is preferable to perform atmospheric pressure non-equilibrium plasma treatment employing dielectric barrier discharge based on streamer electrical breakdown. The dielectric barrier discharge based on the streamer electrical breakdown can be achieved by, for example, applying an alternate high-voltage between electrodes coated with a dielectric body.

Incidentally, various methods other than the above-described dielectric barrier discharge based on the streamer electrical breakdown may be employed as the method to produce the atmospheric pressure non-equilibrium plasma. For example, it may be possible to employ dielectric barrier discharge that occurs by inserting an insulator, such as a dielectric body, between the electrodes, corona discharge that occurs due to a highly non-uniform electric field generated on a thin metal wire or the like, or pulse discharge that occurs by applying a short pulse voltage. Furthermore, two or more of the above methods may be combined.

Figure 3:
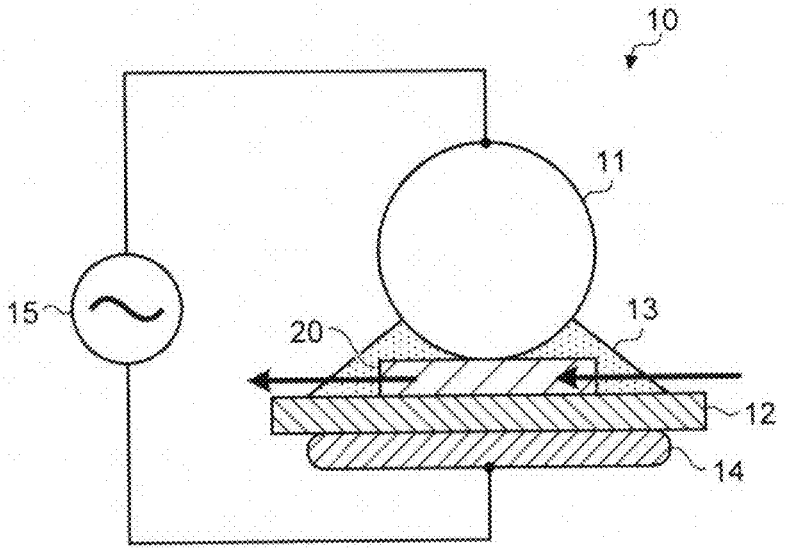
FIG. 3 is a schematic diagram illustrating an overview of the plasma treatment according to the embodiment.

FIG. 3 is a schematic diagram for explaining an overview of the plasma treatment employed in the embodiment. As illustrated in FIG. 3, in the plasma treatment employed in the embodiment, a plasma treatment apparatus 10 including a discharge electrode 11, a ground electrode 14, a dielectric body 12, and a high-frequency high-voltage power supply 15 is used. In the plasma treatment apparatus 10, the dielectric body 12 is disposed between the discharge electrode 11 and the ground electrode 14. The high-frequency high-voltage power supply 15 applies a high-frequency high-voltage pulse voltage between the discharge electrode 11 and the ground electrode 14. The value of the pulse voltage is, for example, about 10 kilovolts (kV). The frequency of the pulse voltage may be set to, for example, about 20 kilohertz (kHz). By supplying the high-frequency high-voltage pulse voltage between the two electrodes, atmospheric pressure non-equilibrium plasma 13 is produced between the discharge electrode 11 and the dielectric body 12. The treatment object 20 passes between the discharge electrode 11 and the dielectric body 12 while the atmospheric pressure non-equilibrium plasma 13 is being produced. Therefore, the surface of the treatment object 20 on the discharge electrode 11 side is subjected to the plasma treatment.

Incidentally, in the plasma treatment apparatus 10 illustrated in FIG. 3, the rotary discharge electrode 11 and the belt-conveyor type dielectric body 12 are employed. The treatment object 20 is conveyed while being nipped between the discharge electrode 11 being rotated and the dielectric body 12, to thereby pass through a space with the atmospheric pressure non-equilibrium plasma 13. Therefore, the surface of the treatment object 20 comes in contact with the atmospheric pressure non-equilibrium plasma 13 and is uniformly subjected to the plasma treatment.

Figure 4:
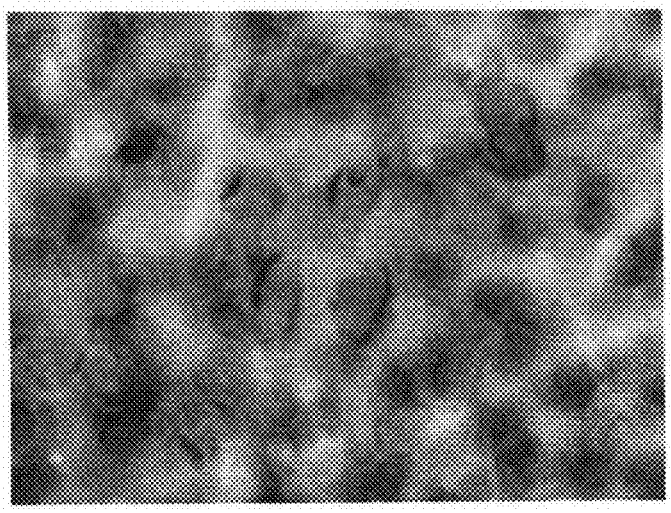
FIG. 4 is an enlarged view of a captured image of an image formation surface of a printed material that is obtained by performing an inkjet recording process on a treatment object that is not subjected to the plasma treatment according to the embodiment.
Figure 5:
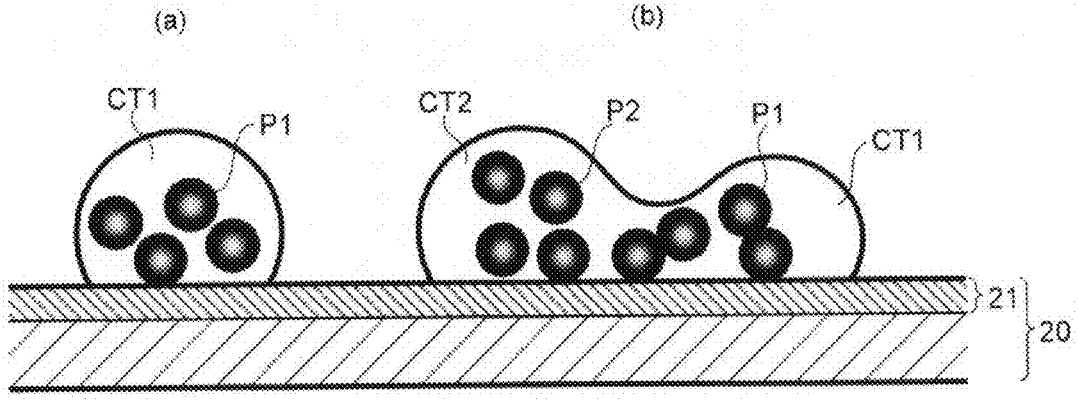
FIG. 5 is a schematic diagram illustrating an example of dots formed on the image formation surface of the printed material illustrated in FIG. 4.
Figure 6:
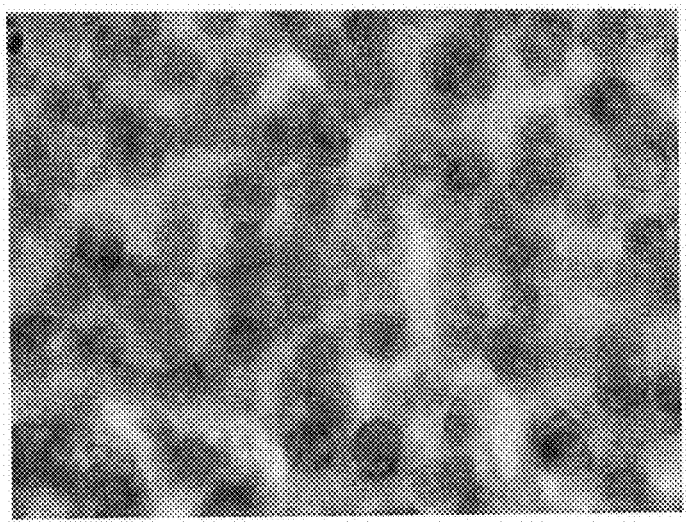
FIG. 6 is an enlarged view of a captured image of an image formation surface of a printed material that is obtained by performing an inkjet recording process on a treatment object subjected to the plasma treatment according to the embodiment.
Figure 7:
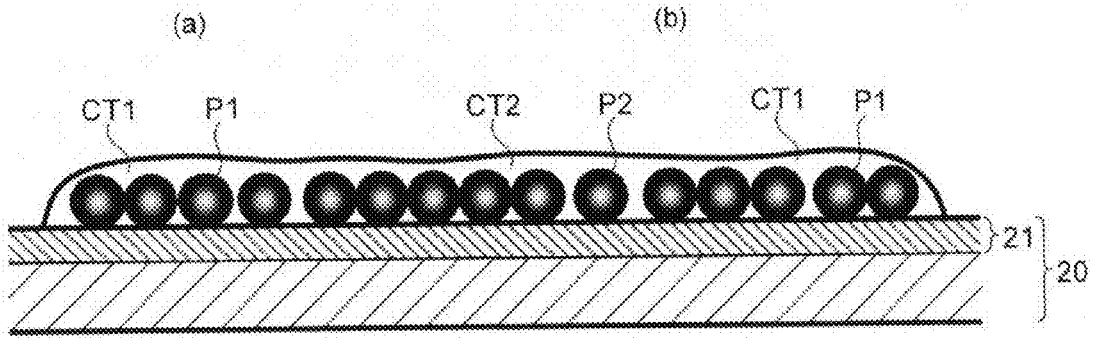
FIG. 7 is a schematic diagram illustrating an example of dots formed on the image formation surface of the printed material illustrated in FIG. 6.

A difference between a printed material that is subjected to the plasma treatment according to the embodiment and a printed material that is not subjected to the plasma treatment according to the embodiment will be explained below with reference to FIG. 4 to FIG. 7. FIG. 4 is an enlarged view of a captured image of an image formation surface of a printed material that is obtained by performing the inkjet recording process on a treatment object that is not subjected to the plasma treatment according to the embodiment. FIG. 5 is a schematic diagram illustrating an example of dots formed on the image formation surface of the printed material illustrated in FIG. 4. FIG. 6 is an enlarged view of a captured image of an image formation surface of a printed material that is obtained by performing the inkjet recording process on a treatment object subjected to the plasma treatment according to the embodiment. FIG. 7 is a schematic diagram illustrating an example of dots formed on the image formation surface of the printed material illustrated in FIG. 6. Incidentally, a desktop type inkjet recording apparatus was used to obtain the printed materials illustrated in FIG. 4 and FIG. 6. Furthermore, a general coated paper including the coated layer 21 (see FIG. 1) was used as the treatment object 20.

If the coated paper is not subjected to the plasma treatment according to the embodiment, the wettability of the coated layer 21 on the surface of the coated paper remains low. Therefore, in the image formed through the inkjet recording process on the coated paper that is not subjected to the plasma treatment, as illustrated in FIG. 4 and FIG. 5 for example, the shape of a dot (the shape of a vehicle CT1) attached to the surface of the coated paper upon landing of the dot is distorted. Furthermore, if an adjacent dot is formed while the dot is not fully dried, as illustrated in FIG. 4 and FIG. 5, the vehicle CT1 and a vehicle CT2 coalesce together when the adjacent dot lands on the coated paper, so that the pigments P1 and pigments P2 move between the dots (color mixture). As a result, density unevenness due to beading or the like may occur.

In contrast, if the coated paper is subjected to the plasma treatment according to the embodiment, the wettability of the coated layer 21 on the surface of the coated paper is improved. Therefore, in the image formed through the inkjet recording process on the coated paper subjected to the plasma treatment, as illustrated in FIG. 6 for example, the vehicle CT1 spreads in a relatively-flat exact circular shape on the surface of the coated paper. Consequently, the shape of the dot becomes flat as illustrated in FIG. 7. Furthermore, the surface of the coated paper is acidified due to the polar functional group generated through the plasma treatment, so that the pigments of the ink are electrically neutralized and the pigments P1 are aggregated, resulting in the increased viscosity of the ink. Therefore, even when the vehicles CT1 and CT2 coalesce together as illustrated in FIG. 7, movement (color mixture) of the pigments P1 and P2 between the dots can be prevented. Moreover, the polar functional group is also generated inside the coated layer 21, so that the permeability of the vehicle CT1 increases and the vehicle can be dried in a relatively short time. The dots that are spread in an exact circular shape due to the improvement of the wettability are aggregated while penetrating into the medium, so that the pigments P1 are uniformly aggregated in the height direction. As a result, it becomes possible to prevent occurrence of density unevenness due to the beading or the like. Incidentally, FIG. 5 and FIG. 7 are schematic diagrams, and in reality, the pigments are aggregated in layers even in the situation illustrated in FIG. 7.

As described above, the surface of the treatment object 20 subjected to the plasma treatment according to the embodiment is acidified due to the polar functional group generated through the plasma treatment. Therefore, the negatively-charged pigments are neutralized on the surface of the treatment object 20, so that the pigments are aggregated and the viscosity increases. As a result, it becomes possible to prevent movement of the pigments even when the dots coalesce together. Furthermore, the polar functional group is also generated inside the coated layer 21 formed on the surface of the treatment object 20, so that the vehicles can quickly penetrate to the inside of the treatment object 20. Therefore, it becomes possible to reduce a drying time. In other words, the dots that are spread in an exact circular shape due to the improvement of the wettability penetrate into the treatment object while preventing the movement of the pigments by the aggregation, and therefore can maintain an approximately exact circular shape.

Figure 8:
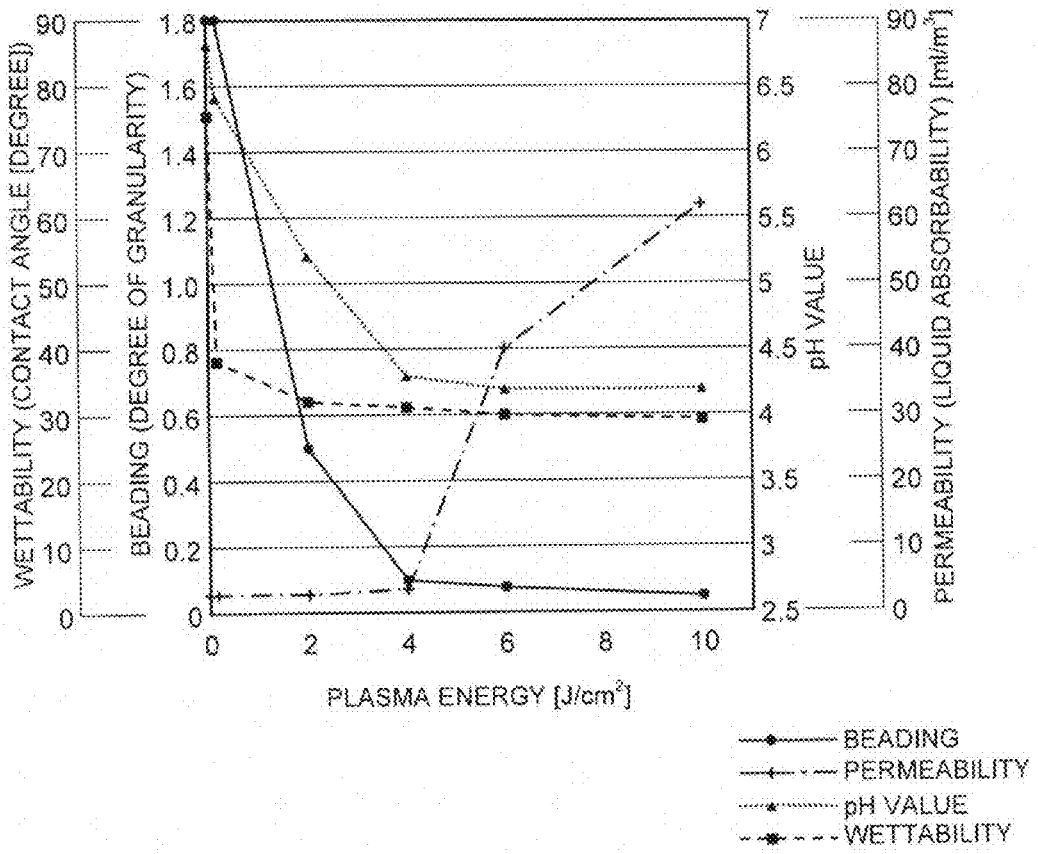
FIG. 8 is a graph showing relationships of wettability, beading, a pH value, and permeability of the surface of a treatment object with respect to plasma energy according to the embodiment.

FIG. 8 is a graph showing relationships of the wettability, the beading, the pH value, and the permeability of the surface of the treatment object with respect to the plasma energy according to the embodiment. FIG. 8 illustrates how the surface property (the wettability, the beading, the pH value, and the permeability (liquid absorbability)) changes depending on the plasma energy when printing is performed on a coated paper serving as the treatment object 20. To obtain the evaluation illustrated in FIG. 8, an aqueous pigment ink of the same color and the same type in which pigments are aggregated with the aid of acid (alkaline ink in which negatively-charged pigments are dispersed) was used as the ink.

As illustrated in FIG. 8, the wettability of the surface of the coated paper is greatly improved when the value of the plasma energy is low (for example, about 0.2 $J/cm^2$ or lower), but is not further improved even if the energy is increased. In contrast, the pH value of the surface of the coated paper decreases to a certain extent with an increase in the plasma energy. However, saturation occurs when the plasma energy exceeds a certain value (for example, about 4 $J/cm^2$). The permeability (liquid absorbability) is greatly improved when a decrease in the pH reaches a saturation point (for example, about 4 $J/cm^2$). However, the phenomenon varies depending on a polymer component contained in the ink.

As a result, the value of the beading (degree of granularity) is maintained in an extremely good state after the permeability (liquid absorbability) starts improving (for example, about 4 $J/cm^2$). The beading (degree of granularity) described herein is a value representing the surface roughness of an image. In particular, the beading represents a variation in the density by a standard deviation of average densities. In FIG. 8, a plurality of densities of a color solid image formed of dots of two or more colors are sampled, and a standard deviation of the densities is represented as the beading (degree of granularity). As described above, an ink ejected on the coated paper subjected to the plasma treatment according to the embodiment is spread in an exact circular shape and penetrates into the coated paper while being aggregated. Therefore, the beading (degree of granularity) in the image can be improved.

As described above, in the relationship between the surface property of the treatment object 20 and the image quality, the dot circularity improves as the wettability of the surface improves. This is because the wettability of the surface of the treatment object 20 is improved and homogenized due to the hydrophilic polar functional group generated through the plasma treatment, and components, such as contaminants, oil, or calcium carbonate, that cause water repellency are removed through the plasma treatment. Due to the improvement of the wettability of the surface of the treatment object 20, the droplets are evenly spread in the circumferential direction, resulting in the improved dot circularity.

Figure 9:
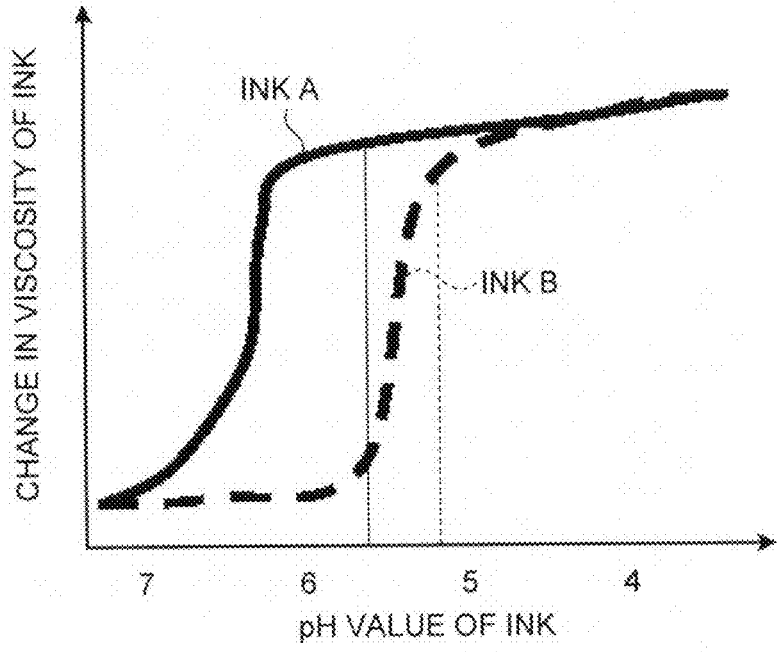
FIG. 9 is a graph showing a relationship between a pH value of an ink and viscosity of the ink according to the embodiment.

Furthermore, by acidifying the surface of the treatment object 20 (by reducing the pH), the ink pigments are aggregated, the permeability is improved, and the vehicles penetrate to the inside of the coated layer 21. Therefore, a pigment density on the surface of the treatment object 20 increases, so that even if the dots coalesce together, it is possible to prevent movement of the pigments. As a result, it becomes possible to prevent mixture of the pigments and cause the pigments to be evenly deposited and aggregated on the surface of the printing medium. However, a pigment-mixture preventing effect varies depending on the components of the ink or the size of the ink droplet. FIG. 9 illustrates an example of a relationship between the pH value of the ink and the viscosity of the ink. In some inks like an ink A illustrated in FIG. 9, pigments are aggregated and the viscosity increases at a pH value relatively close to the neutrality, while in other inks like an ink B as illustrated in FIG. 9, a pH value lower than the pH value of the ink A is needed to aggregate pigments. Therefore, by setting the plasma energy for the plasma treatment to an optimal value according to at least a type of the ink, the surface modification efficiency of the treatment object 20 can be improved, so that further energy saving can be achieved. Furthermore, if the size of the ink droplet is small, the pigments are less likely to be mixed due to the coalescence of the dots compared with a case that the size of the ink droplet is large. This is because, if the size of a vehicle is small, the vehicle can be dried and penetrated more quickly, and the pigments can be aggregated by a slight pH reaction. Moreover, the pigment-mixture preventing effect varies depending on the type of the treatment object 20 or an environment (humidity or the like). Therefore, it may be possible to set the plasma energy for the plasma treatment to an optimal value according to the size of the droplet, the type of the treatment object 20, or the environment.

Figure 10:
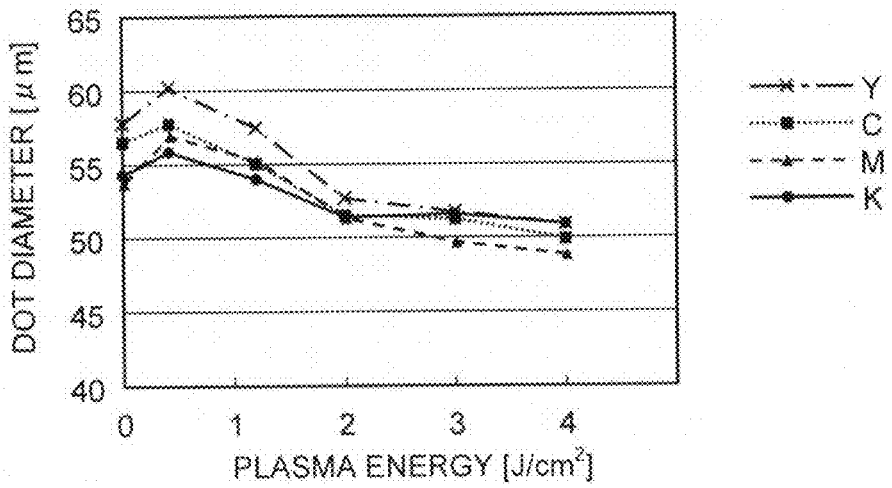
FIG. 10 is a graph showing a relationship between the plasma energy and a dot diameter.
Figure 11:
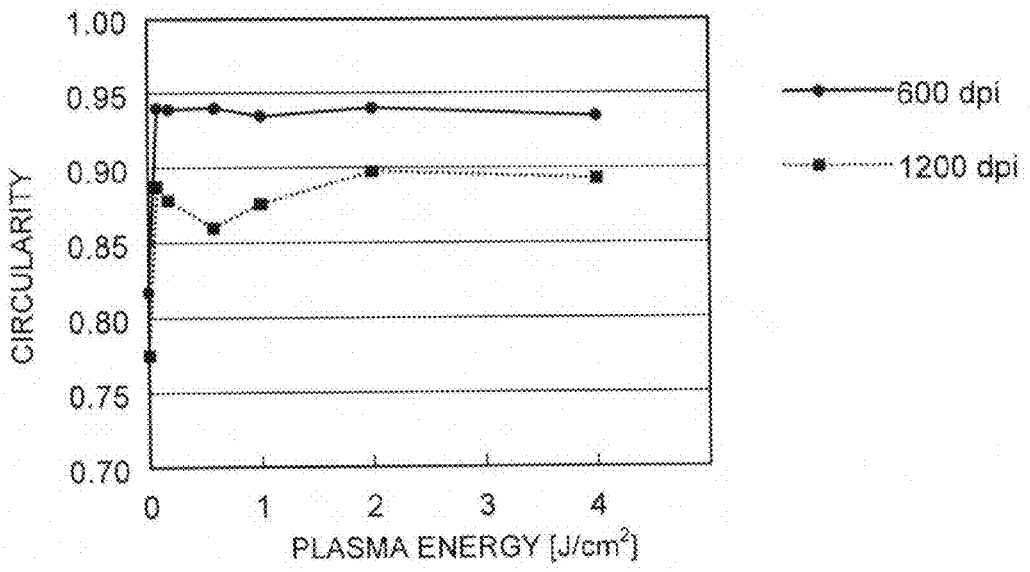
FIG. 11 is a graph showing a relationship between the plasma energy and dot circularity.
Figure 12:
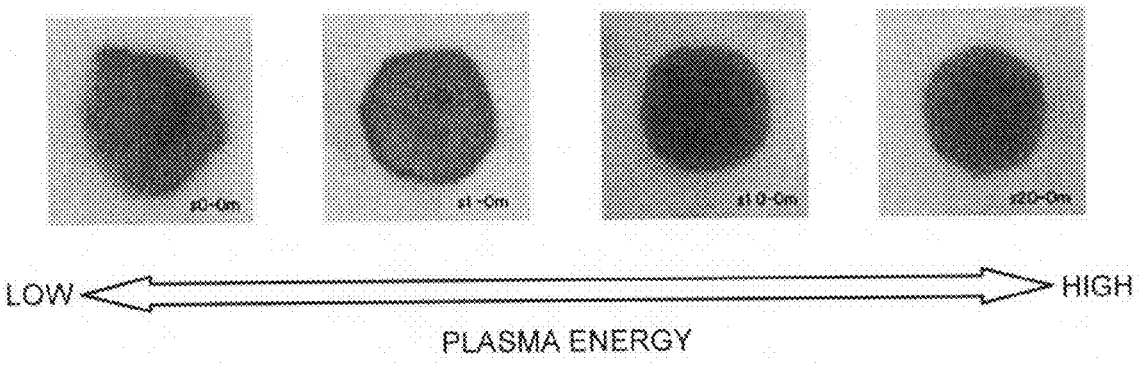
FIG. 12 is a diagram illustrating a relationship between the plasma energy and a shape of an actually-formed dot.

A relationship between the plasma energy and the dot circularity will be explained below. FIG. 10 is a graph showing a relationship between the plasma energy and a dot diameter. FIG. 11 is a graph showing a relationship between the plasma energy and the dot circularity. FIG. 12 is a diagram illustrating a relationship between the plasma energy and a shape of an actually-formed dot. Incidentally, FIG. 10 to FIG. 12 illustrate examples in which an ink of the same color and the same type is used.

As illustrated in FIG. 10, if the plasma energy is increased, the dot diameters of all of CMYK pigments tend to decrease. The reason for this is that a pigment aggregation effect (an increase in the viscosity due to the aggregation) and a permeability effect (penetration of the vehicles into the coated layer 21) are improved because of the plasma treatment, and therefore, the dots are quickly aggregated and penetrated while spreading. By using the effects as described above, it becomes possible to control the dot diameter. Namely, it is possible to control the dot diameter by controlling the plasma energy.

Furthermore, as illustrated in FIG. 11 and FIG. 12, the dot circularity is greatly improved even at a low plasma energy value (for example, about 0.2 J/cm$^2$ or lower). The reason for this is that, as described above, the viscosity of the dot (vehicle) and the permeability of the vehicle are improved by performing the plasma treatment on the treatment object 20, and accordingly, the pigments are uniformly aggregated.

Figure 13:
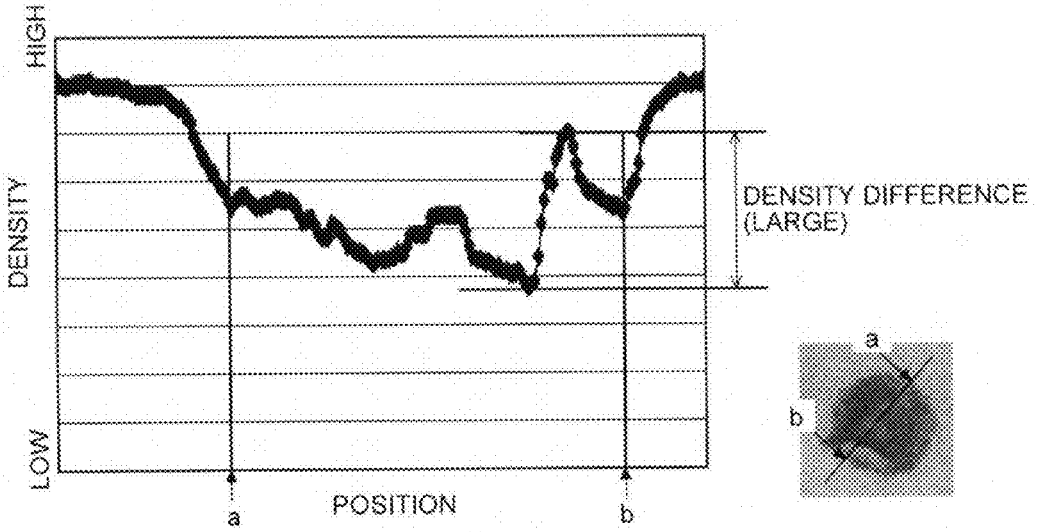
FIG. 13 is a graph showing a pigment density in a dot when the plasma treatment according to the embodiment is not performed.
Figure 14:
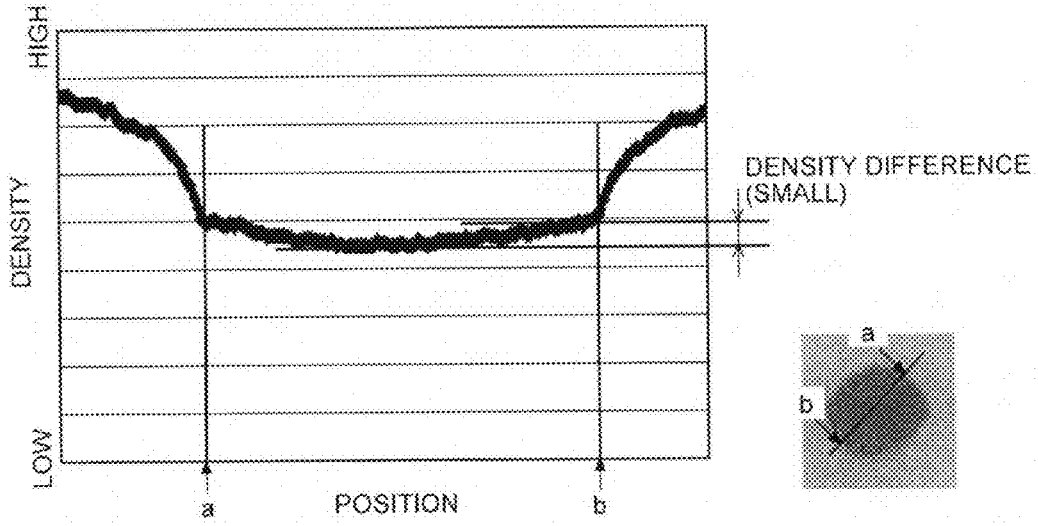
FIG. 14 is a graph showing a pigment density in a dot when the plasma treatment according to the embodiment is performed.

Next, the pigment density in a dot obtained when the plasma treatment is performed and the pigment density in a dot obtained when the plasma treatment is not performed will be explained. FIG. 13 is a graph showing the pigment density of a dot when the plasma treatment according to the embodiment is not performed. FIG. 14 is a graph showing the pigment density of a dot when the plasma treatment according to the embodiment is performed. FIG. 13 and FIG. 14 illustrate the density on a segment a-b in a dot image illustrated in the lower right corner on each of the drawings.

In the measurement illustrated in FIG. 13 and FIG. 14, an image of a formed dot was acquired, density unevenness in the image was measured, and a variation in the density was calculated. As is evident from comparison of FIG. 13 and FIG. 14, a variation in the density (density difference) was more reduced when the plasma treatment was performed (FIG. 14) than when the plasma treatment was not performed (FIG. 13). Therefore, it may be possible to optimize the plasma energy for the plasma treatment so that the variation (density difference) can be minimized based on the variation in the density calculated through the calculation method as described above. Consequently, it becomes possible to form a clearer image.

Incidentally, the method to calculate the variation in the density is not limited to the above method. For example, the variation may be calculated by measuring a thickness of the pigment by an optical interference film thickness measuring means. In this case, it may be possible to select an optimal value of the plasma energy so that a deviation of the thickness of the pigment can be minimized.

Figure 15:
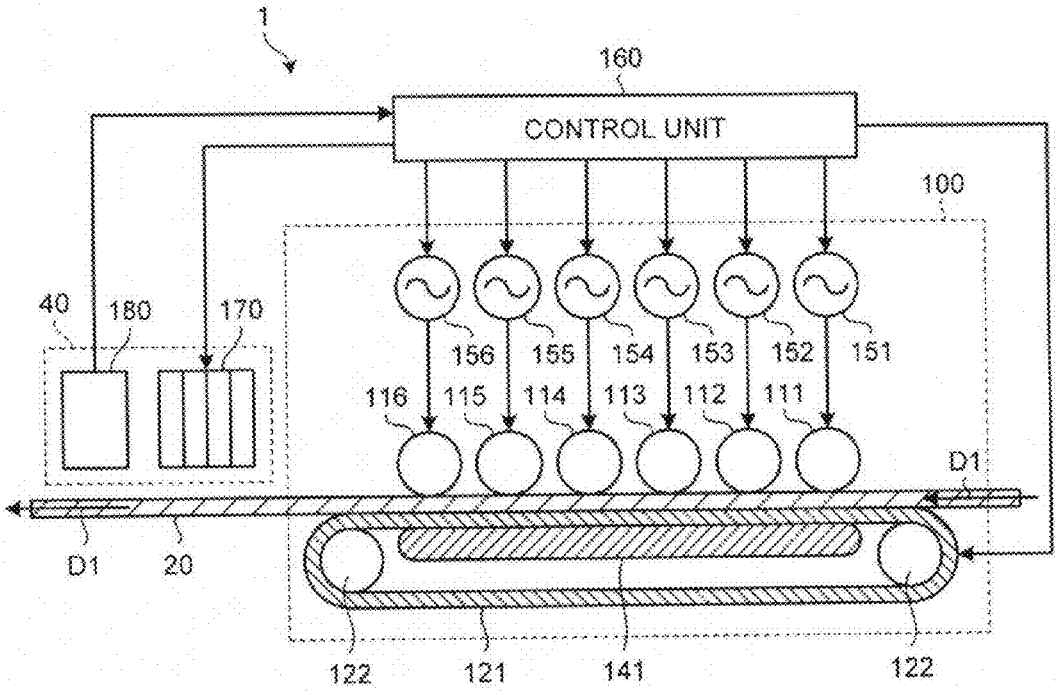
FIG. 15 is a schematic diagram illustrating a detailed configuration of components from a plasma treatment apparatus to a pattern reading unit arranged on the downstream side of an inkjet recording apparatus in the printing apparatus according to the embodiment.

The printing apparatus 1 according to the embodiment will be explained in detail below. In the printing apparatus 1, the pattern reading unit 180 that acquires an image of a formed dot is provided on the downstream side of the inkjet head 170 serving as a recording means for performing the inkjet recording process. Furthermore, in the printing apparatus 1, the acquired image is analyzed to calculate the dot circularity, the dot diameter, a variation in the density, or the like, and feedback control or feedforward control is performed on the plasma treatment apparatus 100 based on the calculation results. FIG. 15 illustrates a detailed configuration of components from the plasma treatment apparatus 100 to the pattern reading unit 180 arranged on the downstream side of the inkjet head 170 in the printing apparatus 1 according to the embodiment. Other configurations are the same as the printing apparatus 1 illustrated in FIG. 2; therefore, detailed explanation thereof will be omitted.

FIG. 15 illustrates the plasma treatment apparatus 100, the inkjet head 170, and the pattern reading unit 180 of the printing apparatus 1. Furthermore, FIG. 15 illustrates a control unit 160 of the printing apparatus 1. The control unit 160 controls each of the units of the printing apparatus 1. The inkjet head 170 performs the inkjet recording process on the surface of the treatment object 20 subjected to the plasma treatment by the plasma treatment apparatus 100 arranged on the upstream side, to thereby form an image. Incidentally, the inkjet head 170 may be controlled by another control unit (not illustrated) separate from the control unit 160.

The plasma treatment apparatus 100 includes a plurality of discharge electrodes 111 to 116 arranged along the conveying path D1, high-frequency high-voltage power supplies 151 to 156 that supply high-frequency high-voltage pulse voltages to the discharge electrodes 111 to 116, respectively, a ground electrode 141 shared by the discharge electrodes 111 to 116, a belt-conveyor type endless dielectric body 121 that is arranged so as to run between the discharge electrodes 111 to 116 and the ground electrode 141 along the conveying path D1, and a roller 122. If the discharge electrodes 111 to 116 arranged along the conveying path D1 are used, it is preferable to employ an endless belt as the dielectric body 121 as illustrated in FIG. 15.

The control unit 160 drives the roller 122 based on an instruction from a higher-level apparatus (not illustrated) to circulate the dielectric body 121. The treatment object 20 is fed onto the dielectric body 121 by the feed unit 30 (see FIG. 2) on the upstream side and then passes through the conveying path D1 along with the circulation of the dielectric body 121.

The high-frequency high-voltage power supplies 151 to 156 supply high-frequency high-voltage pulse voltages to the discharge electrodes 111 to 116, respectively, according to an instruction from the control unit 160. The pulse voltages may be supplied to all of the discharge electrodes 111 to 116, or may be supplied to an arbitrary number of the discharge electrodes 111 to 116 needed to decrease the pH value of the surface of the treatment object 20 to a predetermined value or lower. Alternatively, the control unit 160 may adjust the frequency and a voltage value (corresponding to plasma energy; hereinafter, referred to as "plasma energy") of the pulse voltage supplied by each of the high-frequency high-voltage power supplies 151 to 156 to plasma energy needed to decrease the pH value of the surface of the treatment object 20 to the predetermined value or lower.

The pattern reading unit 180 reads an image that is formed on the treatment object 20 though the inkjet recording process performed by the inkjet head 170. The image formed on the treatment object 20 may be a test pattern for analyzing the dots. In the following explanation, the test pattern is used as an example.

The image acquired by the pattern reading unit 180 is input to the control unit 160. The control unit 160 analyzes the input image to calculate the dot circularity, the dot diameter, a variation in the density, or the like of the test pattern. Furthermore, the control unit adjusts, based on the calculation result, the plasma energy for the plasma treatment performed by the plasma treatment apparatus 100, according to a type of the ink used in the inkjet recording process performed by the inkjet head 170. Specifically, the control unit adjusts the number of the discharge electrodes 111 to 116 to be driven and/or the plasma energy of the pulse voltage to be supplied by each of the high-frequency high-voltage power supplies 151 to 156 to each of the discharge electrodes 111 to 116.

As one method to obtain the plasma energy needed to perform necessary and sufficient plasma treatment on the surface of the treatment object 20, it may be possible to increase the time of the plasma treatment. This can be achieved by, for example, decreasing the conveying speed of the treatment object 20. However, to record an image on the treatment object 20 at high speed, it is desirable to reduce the time of the plasma treatment. As a method to reduce the time of the plasma treatment, as described above, it may be possible to provide a plurality of the discharge electrodes 111 to 116 and drive a necessary number of the discharge electrodes 111 to 116 according to the print speed and necessary plasma energy, or to adjust the intensity of the plasma energy to be applied to each of the discharge electrodes 111 to 116. However, the method is not limited to the above methods, and may be changed appropriately by combining the above methods or by applying other methods.

As illustrated in FIG. 15, the inkjet head 170 may include a plurality of heads for the same color (4 colors×4 heads). With this configuration, the speed of the inkjet recording process can be increased. In this case, for example, to obtain the resolution of 1200 dpi at high speed, the heads of each of the colors in the inkjet head 170 are fixedly displaced from one another so as to correct a gap between nozzles for ejecting inks. Furthermore, drive pulses with various drive frequencies are input to the heads of each of the colors so that an ink dot ejected from each of the nozzles can correspond to three different sizes of a large droplet, a medium droplet, and a small droplet. Incidentally, it may be possible to set different types of inks of the same color in the heads of the same color.

The control unit 160 can individually turn on and off the high-frequency high-voltage power supplies 151 to 156. For example, the control unit 160 selects the number of the high-frequency high-voltage power supplies 151 to 156 to be driven in proportion to print speed information, or adjusts the intensity of the plasma energy of the pulse voltage to be applied to each of the discharge electrodes 111 to 116. Alternatively, the control unit 160 may adjust the number of the high-frequency high-voltage power supplies 151 to 156 to be driven or adjust the intensity of the plasma energy to be applied to each of the discharge electrodes 111 to 116 depending on the color of the ink, the type of the ink, or the type of the treatment object 20 (for example, a coated paper, a polyester (PET) film, or the like).

If a plurality of the discharge electrodes 111 to 116 are provided, it is advantageous to uniformly perform the plasma treatment on the surface of the treatment object 20. Specifically, if the conveying speed (or the print speed) is the same, it is possible to increase the time for the treatment object 20 to pass through a plasma space when the plasma treatment is performed with a plurality of discharge electrodes than when the plasma treatment is performed with a single discharge electrode. Therefore, it becomes possible to uniformly perform the plasma treatment on the surface of the treatment object 20.

Figure 16:
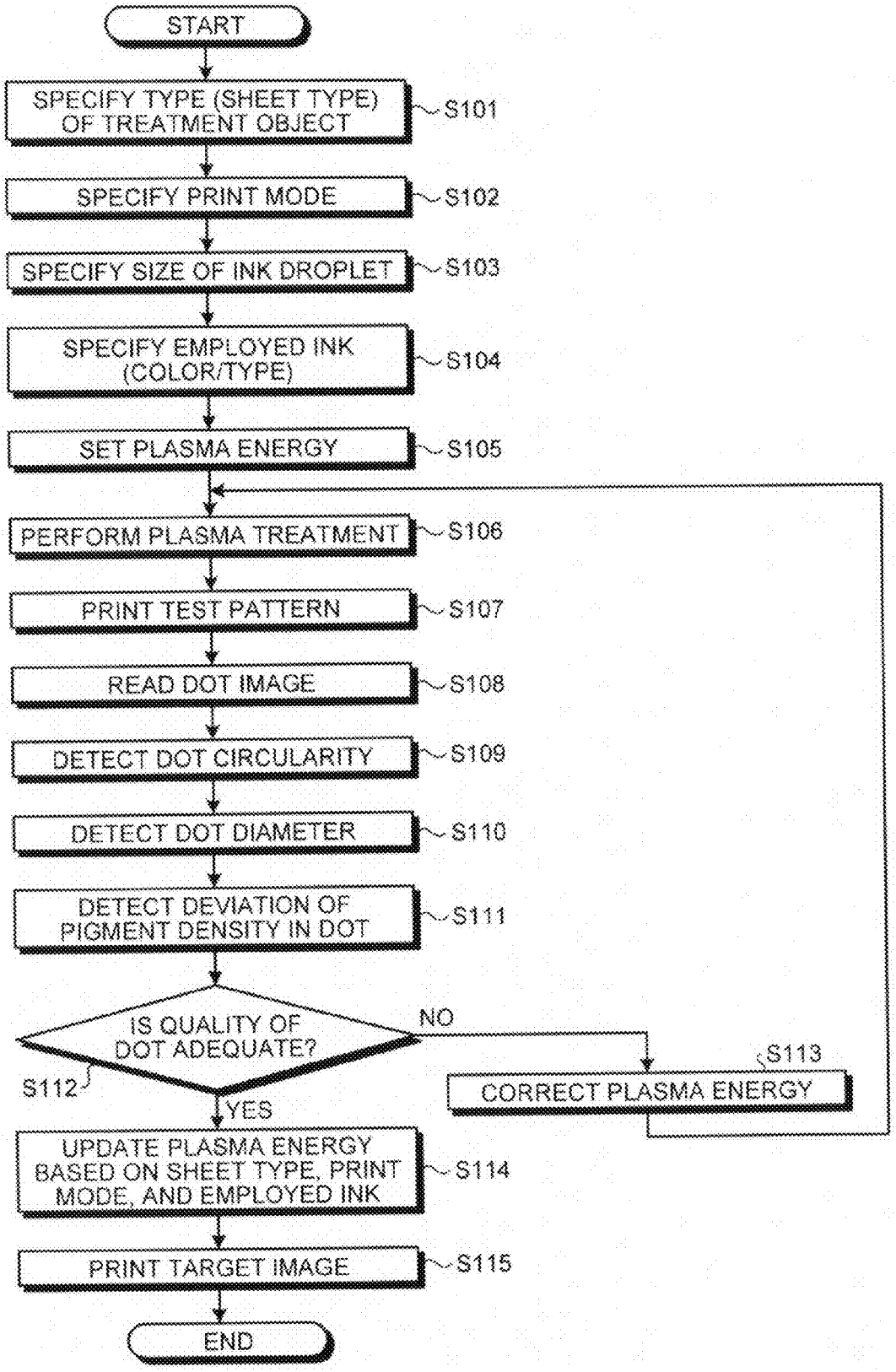
FIG. 16 is a flowchart illustrating an example of a printing process including plasma treatment according to the embodiment.

A printing process including the plasma treatment according to the embodiment will be explained in detail below with reference to the drawings. FIG. 16 is a flowchart illustrating an example of the printing process including the plasma treatment according to the embodiment. FIG. 17 is a diagram illustrating an example of a table used to specify the size of an ink droplet and the plasma energy in the flowchart illustrated in FIG. 16. In FIG. 16, an example is illustrated in which the printing apparatus 1 illustrated in FIG. 15 performs printing by using a cut sheet (a recording medium that is cut in a predetermined size) as the treatment object 20. The same printing process can be applied to a roll sheet that is rolled up, instead of the cut sheet.

As illustrated in FIG. 16, in the printing process, the control unit 160 specifies a type (sheet type) of the treatment object 20 (Step S101). The type of the treatment object 20 (sheet type) may be set and input to the printing apparatus 1 by a user via a control panel (not illustrated). Alternatively, the printing apparatus 1 may include a sheet type detecting means (not illustrated), and the control unit 160 may specify the sheet type based on sheet type information detected by the sheet type detecting means. Incidentally, the sheet type detecting means may be, for example, a unit that applies laser light to the surface of a sheet and analyzes interference spectrum of the reflected light to specify the sheet type, a unit that measures the thickness of the sheet and specify the sheet, or a barcode reader that reads a barcode, which is printed on the surface of the sheet and which contains information on the sheet type. The control unit 160 also specifies a print mode (Step S102). The print mode may be resolution (600 dpi, 1200 dpi, or the like) of an image of a printed material, and may be set by the user using an input unit (not illustrated). Alternatively, the print mode may be input from an external higher-level apparatus (for example a DFE 210 to be described later), together with image data (raster data). Furthermore, the print mode may include monochrome printing or color printing.

Subsequently, the control unit 160 specifies the size of an ink droplet for image formation (Step S103). The size of the ink droplet may be specified from a table as illustrated in FIG. 17 based on, for example, the specified print mode and the dot size. For example, if the print mode is 1200 dpi and the dot size is a small droplet, the size of the ink droplet can be specified as 2 picoliters (pl) based on the table illustrated in FIG. 17. For another example, if the print mode is 600 dpi and the dot size is a large droplet, the size of the ink droplet can be specified as 15 pl. Incidentally, the dot size is the size of a droplet ejected by the inkjet head 170 or the size of a dot formed on the treatment object 20, and may be specified by the control unit 160 based on image information on the printing object.

Subsequently, the control unit 160 specifies a color and/or a type of an ink (employed ink) to be used to print a target image (Step S104). In this case, it may be possible to specify a single color or a single type of the employed ink for entire image data of a printing object, or may divide the image data into regions according to types of employed inks (or according to objects contained in the image data) and specify a color or a type of the employed ink for each of the regions. Incidentally, the color of the employed ink may be specified based on, for example, a color used in the raster data of the input image data and a color of the ink set in the inkjet head 170. Furthermore, the type of the employed ink may be specified based on, for example, the color used in the raster data of the input image data and a type of the ink set in the inkjet head 170. The color and the type (model number or the like) of the ink set in the inkjet head 170 may be set and input by a user via the control panel (not illustrated). Alternatively, the inkjet head 170 may include a detecting unit that detects the color and the type of the set ink.

Subsequently, the control unit 160 sets plasma energy for the plasma treatment (Step S105). The plasma energy as a target to be set (optimal value of the plasma energy) can be specified from the table as illustrated in FIG. 17 based on the color and/or the type of the employed ink, the type (sheet type) of the treatment object 20, and the size of the ink droplet specified as described above. For example, if the type of the treatment object 20 is a plain paper A, the size of the ink droplet is 6 pl, and the employed ink is YMCK ink, the control unit 160 sets the plasma energy to 0.11 J/cm$^2$. Incidentally, if the color or the type of the employed ink is specified for each of the regions at Step S104, it may be possible to change the plasma energy for each of the regions.

While the optimal value of the plasma energy is registered in the table illustrated in FIG. 17, the present invention is not limited to this example. For example, it may be possible to register a voltage value and a pulse duration of the pulse voltage to be supplied by the high-frequency high-voltage power supplies 151 to 156 to the discharge electrodes 111 to 116. Furthermore, while the optimal value of the plasma energy registered in the table illustrated in FIG. 17 varies depending a color print mode (YMCK), a monochrome print mode (K), and a single-color print mode (in the example in FIG. 17, a single color of magenta (M)), it may be possible to register types of employed inks so as to subdivide each of the color print mode (YMCK), the monochrome print mode (K), and the single-color print mode (M) so that the optimal value of the plasma energy varies depending on the types of the employed inks. Moreover, the table illustrated in FIG. 17 may be divided into a part used at Step S103 and a part used at Step S105. Furthermore, at Step S105, it may be possible to select the greatest possible plasma energy for each of the types of the inks, without taking the resolution, the sheet type, and the size of the droplet into consideration.

Moreover, if two colors or two types of inks are used, it may be possible to set, at Step S105, the plasma energy according to any one of the employed inks. In this case, for example, it may be possible to set the plasma energy according to an employed ink with which the dot diameter becomes the greatest, or to set the plasma energy according to an employed ink with which the dot diameter becomes the smallest. This can be realized by registering, in the table illustrated in FIG. 17, the optimal value of the plasma energy for a combination of employed inks, instead of for the color print mode (YMCK), the monochrome print mode (K), and the single-color print mode (M). In this case, the optimal value of the plasma energy corresponding to an employed ink with which the dot diameter becomes the greatest or the smallest among combinations of employed inks is registered in the table illustrated in FIG. 17.

Subsequently, the control unit 160 appropriately supplies the pulse voltage from the high-frequency high-voltage power supplies 151 to 156 to the discharge electrodes 111 to 116 based on the set plasma energy, to thereby perform the plasma treatment on the treatment object 20 (Step S106). The control unit 160 prints a test pattern on the treatment object 20 subjected to the plasma treatment (Step S107). The control unit 160 captures an image of a dot of the test pattern by using the pattern reading unit 180 and reads the image of the dot (dot image) formed on the treatment object 20 subjected to the plasma treatment (Step S108).

The control unit 160 detects the dot circularity (Step S109), the dot diameter (Step S110), a deviation of the pigment density in the dot (a variation or density difference) (Step S111) from the read dot image. Alternatively, the control unit 160 may determine the coalescence state of dots from the read dot image. The coalescence state of the dots can be determined by, for example, pattern recognition.

The control unit 160 determines whether the quality of the formed dot is adequate based on the dot circularity, the dot diameter, and the deviation of the pigment density in the dot, (or also based on the coalescence state of the dots) that are detected as above (Step S112). If the quality is not adequate (NO at Step S112), the control unit 160 corrects the plasma energy according to the dot circularity, the dot diameter, and the deviation of the pigment density in the dot (or also according to the coalescence state of the dots) that are detected as above (Step S113), and returns the process to Step S106 to analyze the dot from the printed test pattern. The correction may be performed by increasing or decreasing the set plasma energy based on a correction value of a predetermined amount set in advance. Alternatively, the correction may be performed by calculating optimal plasma energy according to the dot circularity, the dot diameter, and the deviation of the pigment density in the dot (or also according to the coalescence state of the dots) that are detected as above, and resetting the plasma energy to the optimal value.

In contrast, if the quality of the dot is adequate (YES at Step S112), the control unit 160 updates the plasma energy registered in the table in FIG. 17 based on the type (sheet type) of the treatment object 20, the print mode, and the employed ink specified as above (Step S114), prints an image that is an actual printing object (Step S115), and ends the process upon completion of the printing.

Incidentally, the processes from Steps S101 to S114 in FIG. 16 may be performed separately from an actual printing process (Step S115). Specifically, generation and update of the table illustrated in FIG. 17 may be performed as a separate process independent of actual image printing. For example, it may be possible to allow a user to instruct the printing apparatus 1 to perform the processes from S101 to S114 before a start of a printing process or during a printing process. Alternatively, it may be possible to detect a change in the dot diameter during printing, and interrupt the printing process and automatically perform the processes from S101 to S114 by using, as a trigger, detection that the dot diameter greatly changes or that the dot diameter exceeds an allowable range. Furthermore, the processes from Step S107 to Step S114 may be performed for each printing process or at each predetermined timing, and the process at Step S115 may be performed after the process at Step S106 in the actual printing.

Incidentally, if a roll sheet is used as the treatment object 20, it may be possible to acquire, at Steps S106 to S113, a dot image that is formed on a leading end portion of a sheet guided by a sheet feed device (not illustrated) after the plasma treatment. If the roll sheet is used, because the property of the same roll remains almost unchanged, it becomes possible to stably perform continuous printing with the same setting after the plasma energy is adjusted by using the leading end portion. However, if the printing is suspended for a long time before the roll sheet is used up, the property of the sheet may be changed. Therefore, before the printing is resumed, it is preferable to acquire and analyze a dot image that is formed on the leading end portion subjected to the plasma treatment in the same manner as described above. Alternatively, after the dot image that is formed on the leading end portion subjected to the plasma treatment is analyzed and then the plasma energy is adjusted, it may be possible to periodically or continuously measure the dot image and adjust the plasma energy. With this configuration, it becomes possible to more precisely and stably perform the control.

Furthermore, while the table as illustrated in FIG. 17 is used in the process in FIG. 16, the present invention is not limited to this method. For example, it may be possible to set initial plasma energy to a minimum value, and gradually increase the plasma energy based on an analysis result of a dot image of an obtained test pattern.

Figure 18:
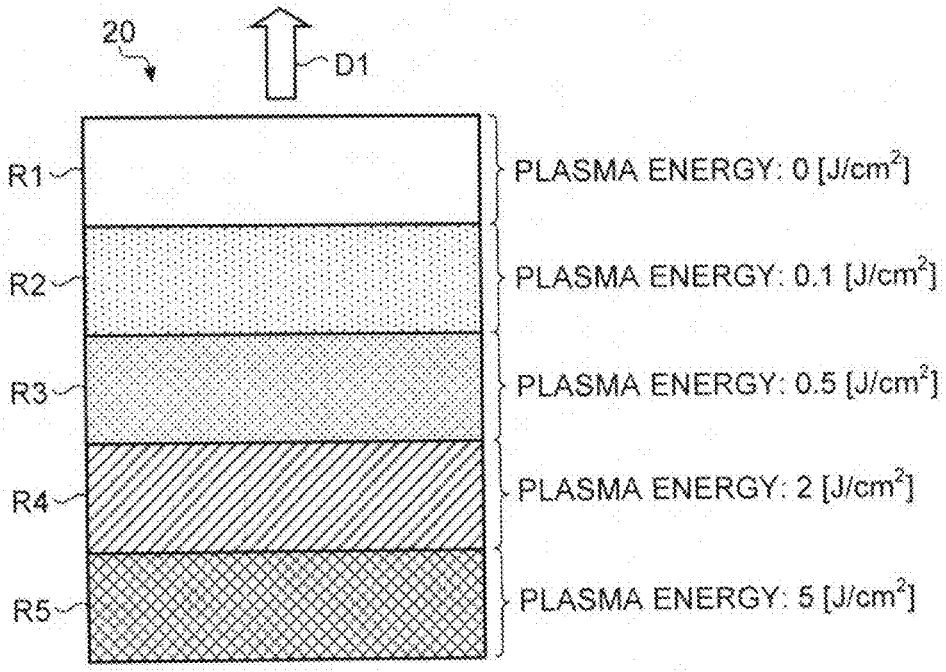
FIG. 18 is a diagram illustrating an example of a treatment object subjected to the plasma treatment at Step S106 in FIG. 16.

If the plasma energy is gradually increased from the minimum value, it may be possible to change the plasma energy to be applied to each of the discharge electrodes 111 to 116 in FIG. 15 such that the plasma energy gradually increases from the downstream side, or it may be possible to change the conveying speed of the treatment object 20, that is, the circulation speed of the dielectric body 121. As a result, at Step S106 in FIG. 16, as illustrated in FIG. 18, it becomes possible to obtain the treatment object 20 in which each of regions is subjected to the plasma treatment with different plasma energy. Incidentally, In FIG. 18, a region R1 is not subjected to the plasma treatment (the plasma energy=0 J/cm$^2$), a region R2 is subjected to the plasma treatment with the plasma energy of 0.1 J/cm$^2$, a region R3 is subjected to the plasma treatment with the plasma energy of 0.5 J/cm$^2$, a region R4 is subjected to the plasma treatment with the plasma energy of 2 J/cm$^2$, and a region R5 is subjected to the plasma treatment with the plasma energy of 5 J/cm$^2$.

Figure 19:
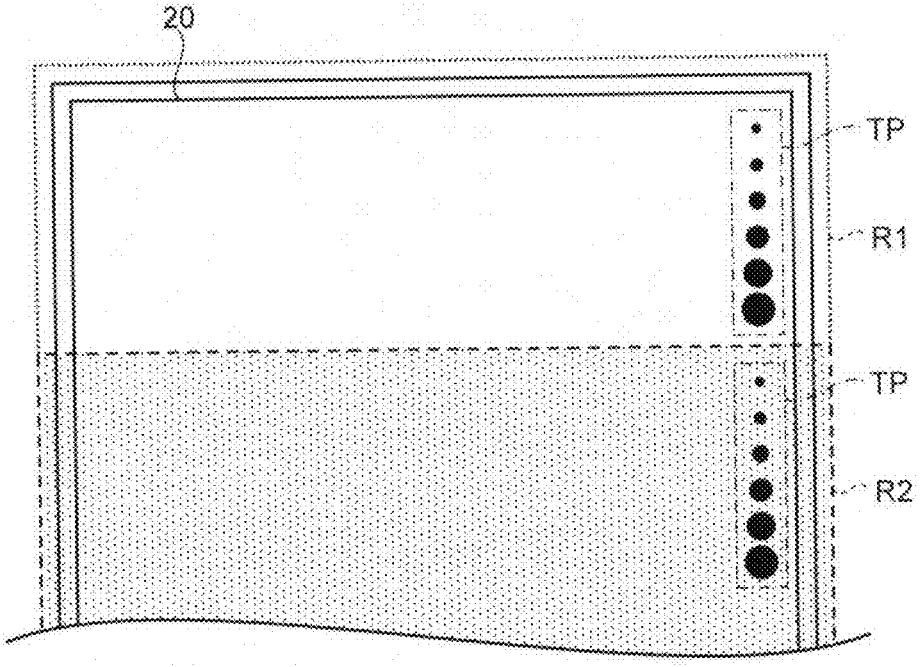
FIG. 19 is a diagram illustrating an example of a test pattern formed at Step S107 in FIG. 16.
Figure 20:
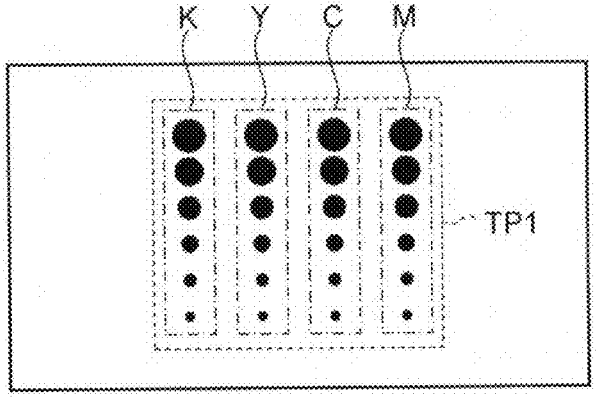
FIG. 20 is a diagram illustrating another example of the test pattern.

Furthermore, in the case of the treatment object 20 in which each of the regions is subjected to the plasma treatment with different plasma energy as illustrated in FIG. 18, for example, it may be possible to form, at Step S107 in FIG. 16, a common test pattern TP containing a plurality of dots with different dot diameters as illustrated in FIG. 19 in each of the regions R1 to R5. Alternatively, the test pattern illustrated in FIG. 19 may be replaced with a test pattern TP1 containing a plurality of dots with different dot diameters for each of CMYK as illustrated in FIG. 20.

Figure 21:
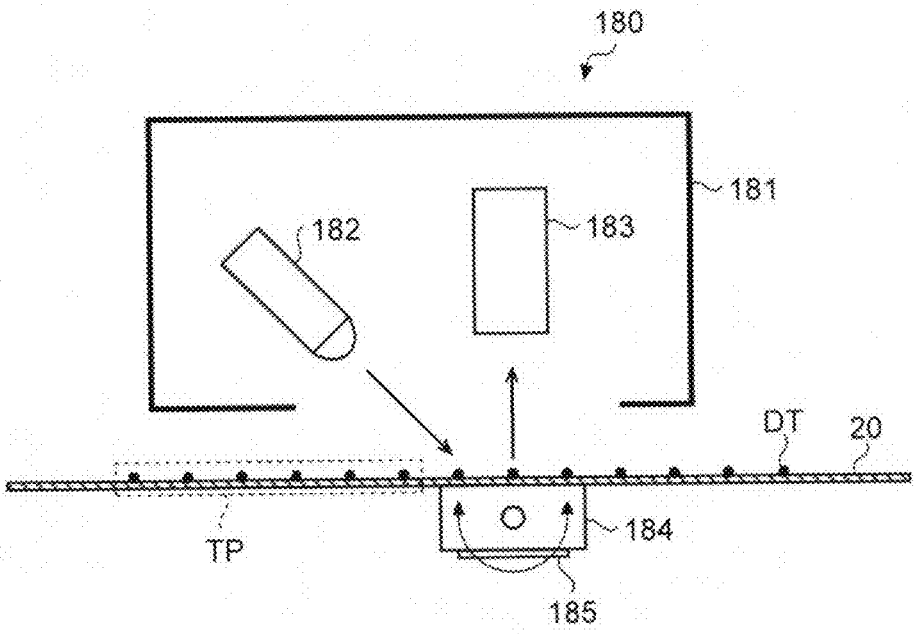
FIG. 21 is a schematic diagram illustrating an example of the pattern reading unit according to the embodiment.

The test pattern TP formed as described above is read by the pattern reading unit 180 illustrated in FIG. 15 at Step S108 in FIG. 16. FIG. 21 illustrates an example of the pattern reading unit 180 according to the embodiment.

As illustrated in FIG. 21, for example, a reflective two-dimensional sensor including a light-emitting unit 182 and a light-receiving unit 183 is used as the pattern reading unit 180. For example, the light-emitting unit 182 and the light-receiving unit 183 are arranged in a case 181 that is disposed on a dot formation side with respect to the treatment object 20. An opening is arranged on the treatment object 20 side of the case 181, and light emitted by the light-emitting unit 182 is reflected from the surface of the treatment object 20 and incident on the light-receiving unit 183. The light-receiving unit 183 forms an image with the amount of the reflected light (the intensity of the reflected light) reflected from the surface of the treatment object 20. The amount (intensity) of the reflected light of a formed image varies between a portion with a printed image (a dot DT of the test pattern TP) and a portion without the printed image. Therefore, it is possible to detect the dot shape and the image density in the dot based on the amount of the reflected light (the intensity of the reflected light) detected by the light-receiving unit 183. Incidentally, the configuration and the detection method of the pattern reading unit 180 may be changed in various forms as long as the pattern reading unit 180 can detect the test pattern TP printed on the treatment object 20.

Furthermore, the pattern reading unit 180 may include a reference pattern display unit 184 including a reference pattern 185, as a means for performing calibration of the light intensity of the light-emitting unit 182 and the read voltage of the light-receiving unit 183. The reference pattern display unit 184 has a cuboid shape made with, for example, a predetermined treatment object (for example, a plain paper), and the reference pattern 185 is attached to one of the surfaces of the reference pattern display unit 184. When performing the calibration on the light-emitting unit 182 and the light-receiving unit 183, the reference pattern display unit 184 rotates so that the reference pattern 185 faces the light-emitting unit 182 and the light-receiving unit 183 side. When the calibration is not performed, the reference pattern display unit 184 rotates so that the reference pattern 185 does not face the light-emitting unit 182 and the light-receiving unit 183 side. Incidentally, the reference pattern 185 may be formed in the same manner as the test pattern TP or the test pattern TP1 illustrated in FIG. 19 or FIG. 20 for example.

In the embodiment, an example is explained that the plasma energy is adjusted based on the analysis result of the dot image acquired by the pattern reading unit 180; however, the present invention is not limited to this example. For example, a user may set the plasma energy based on the test pattern TP that is formed, at Step S107 in FIG. 16, on the treatment object 20 subjected to the plasma treatment.

Figure 22:
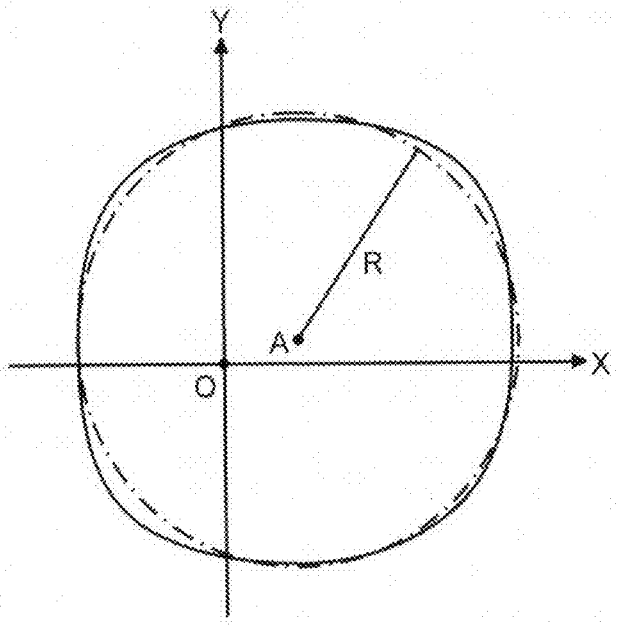
FIG. 22 is a diagram illustrating an example of a captured image of a dot according to the embodiment.

An exemplary method to discriminate the size of the dot of the test pattern formed on the treatment object 20 will be explained below with reference to the drawings. To discriminate the size of the dot of the test pattern, the test pattern TP or TP1 as illustrated in FIG. 19 or FIG. 20 is recorded on the treatment object 20 subjected to the plasma treatment, and the pattern reading unit 180 captures an image of the test pattern TP or TP1 and an image of the reference pattern 185 to acquire a captured image of a dot (dot image) as illustrated in FIG. 22. Incidentally, the reference pattern 185 is located at any position in the entire imaging region of the light-receiving unit 183 (the entire imaging region of the two-dimensional sensor) illustrated in FIG. 21, and the position is recognized by measurement in advance. The control unit 160 compares pixels of the dot image of the acquired test pattern TP or TP1 with pixels of the dot image of the reference pattern 185, to thereby perform calibration on the dot image of the test pattern TP or TP1. In this case, as illustrated in FIG. 22, a circle-like figure that is not a complete circle (for example, the outline of the dot of the test pattern TP or TP1: a solid line) is obtained and then fitting is performed on the circle-like figure by an exact circle (the outline of the dot of the reference pattern 185: a chain line). In the fitting, the least squares method is employed.

Figure 23:
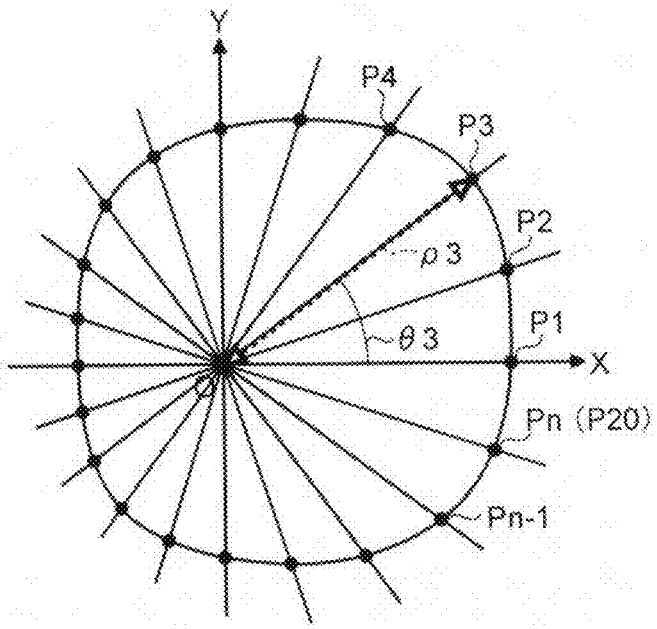
FIG. 23 is a diagram for explaining a sequence for applying a least squares method to the captured image illustrated in FIG. 22.

As illustrated in FIG. 23, in the least squares method, an origin O is taken at an approximately center position and the XY coordinate is set with respect to the origin O to quantify a deviation between the circle-like figure (solid line) and the exact circle (chain line), and thereafter, a final optimal center point A (coordinate (a, b)) and a radius R of the exact circle are to be obtained. Therefore, first, the circumference ($2\pi$) of the circle-like figure is equally divided based on angles, and angles $\theta_i$ with respect to the X axis and a distance $\rho_i$ from the origin O are obtained for each of data points P1 to Pn obtained by the division. If the number of the data points (i.e., the number of data sets) is assumed as "N", Equation (1) below is obtained based on trigonometric relations.

$$x_i=\rho_i \cos \theta_i$$

$$y_i=\rho_i \sin \theta_i \quad (1)$$

In this case, the optimal center point A (coordinate (a, b)) and the radius R of the exact circle are given by Equation (2) below.

$$R = \frac{\sum_{i=1}^{N} \rho_i}{N} \quad (2)$$

$$a = \frac{2\sum_{i=1}^{N} x_i}{N}$$

$$b = \frac{2\sum_{i=1}^{N} y_i}{N}$$

As described above, the dot image of the reference pattern 185 is read, and the calibration is performed by comparing the dot diameter calculated by the least squares method as described above with the diameter of the reference chart. After the calibration, the dot image printed in the pattern is read and the diameter of the dot is calculated.

Furthermore, the circularity is generally represented by a difference between radii of two concentric geometric circles under conditions that the circle-like figure is sandwiched by the two concentric circles with a minimum gap between the two concentric circles. However, a ratio of the minimum diameter to the maximum diameter of a concentric circle may be defined as the circularity. In this case, if a value of the ratio of the minimum diameter to the maximum diameter becomes "1", the figure is an exact circle. The circularity can also be calculated by the least squares method if the dot image is acquired.

The maximum diameter can be obtained as a maximum distance among all distances between the center of the dot of the acquired image and each of the points on the circumference. In contrast, the minimum diameter can be calculated as a minimum distance among all distances between the center point of the dot and each of the points on the circumference.

The dot diameter and the dot circularity vary depending on the color or the type of the employed ink or the ink penetration state of the treatment object 20. In the embodiment, the dot shape (circularity) or the dot diameter is controlled so as to reach a target value according to the color or the type of the employed ink, the type of the treatment object 20, or an ink ejection amount in order to improve the image quality. Furthermore, in the embodiment, the formed image is read and analyzed to adjust the plasma energy for the plasma treatment such that the dot diameter for each of the ink ejection amount becomes a target dot diameter in order to achieve high image quality.

Moreover, in the embodiment, because the pigment density in the dot can be detected based on the intensity of the reflected light, the dot image is acquired and the density in the dot is measured. By calculating the density value as a deviation distribution through a statistic calculation, density unevenness is calculated. Furthermore, by selecting the plasma energy so that the calculated density unevenness can be minimized, it becomes possible to prevent mixture of pigments due to coalescence of the dots. Therefore, it becomes possible to achieve higher image quality. It may be possible to allow a user to switch between modes, for example, a mode in which priority is given to control of the dot diameter, a mode in which priority is given to prevention of the density unevenness, or a mode in which priority is given to improvement of the circularity, according to the user's preference.

As described above, in the embodiment, the plasma energy is controlled according to the color or the type of ink so that the unevenness of the dot circularity or the pigments in the dot can be reduced or the dot diameter becomes a target size. Therefore, it becomes possible to provide a printed material with high image quality while equalizing dot diameters and realizing energy-saving. Furthermore, even when the property of the treatment object or the print speed is changed, it becomes possible to stably perform the plasma treatment. Therefore, it becomes possible to stably perform image recording in good conditions.

In the embodiment described above, a case has been explained that the plasma treatment is performed mainly on the treatment object. However, because the wettability of the ink with respect to the treatment object is improved by performing the plasma treatment as described above, a dot attached through the inkjet recording is spread, and therefore, a recorded image may differ from an image loaded on an untreated treatment object. To cope with this, when an image is to be printed on a recording medium subjected to the plasma treatment, it may be possible to, for example, reduce an ink ejection voltage to reduce the size of the ink droplet at the inkjet recording. As a result, it becomes possible to reduce the size of the ink droplet, enabling to reduce costs.

Figure 24:
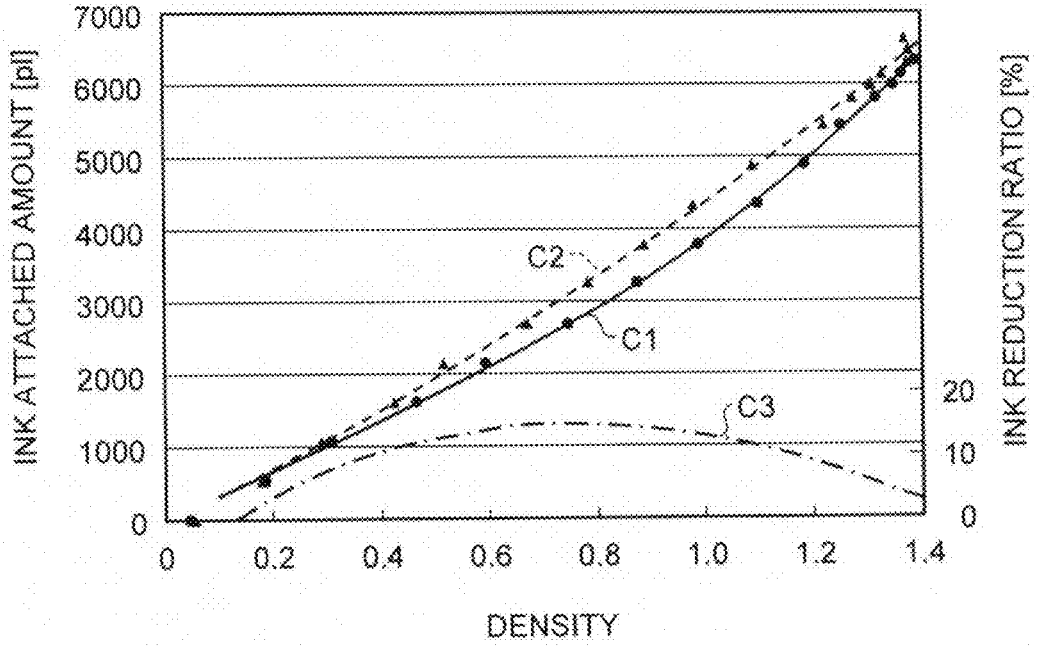
FIG. 24 is a graph showing a relationship between the plasma energy and a pH according to the embodiment.

FIG. 24 is a graph showing a relationship between an ink ejection amount and an image density according to the embodiment. In FIG. 24, a solid line C1 represents a relationship between the ink ejection amount and the image density when the plasma treatment according to the embodiment is performed, a broken line C2 represents a relationship between the ink ejection amount and the image density when the inkjet recording process is performed on a treatment object that is not subjected to the plasma treatment according to the embodiment, and a chain line C3 represents an ink reduction ratio of the broken line C2 to the solid line C1.

As is evident from comparison of the solid line C1 and the broken line C2 in FIG. 24 and from a chain line C3, by performing the plasma treatment according to the embodiment on the treatment object 20 before the inkjet recording process, it becomes possible to reduce the ink ejection amount needed to obtain the same image density because the dot circularity can be improved, the dot can be enlarged, or the pigment density in the dot can be equalized.

Furthermore, by performing the plasma treatment according to the embodiment on the treatment object 20 before the inkjet recording process, the thickness of the pigment attached to the treatment object 20 can be reduced, so that color saturation can be improved and a color gamut can be enhanced. Moreover, because the amount of the ink is reduced, energy for drying the ink can also be reduced, so that it becomes possible to achieve an energy-saving effect.

Figure 25:
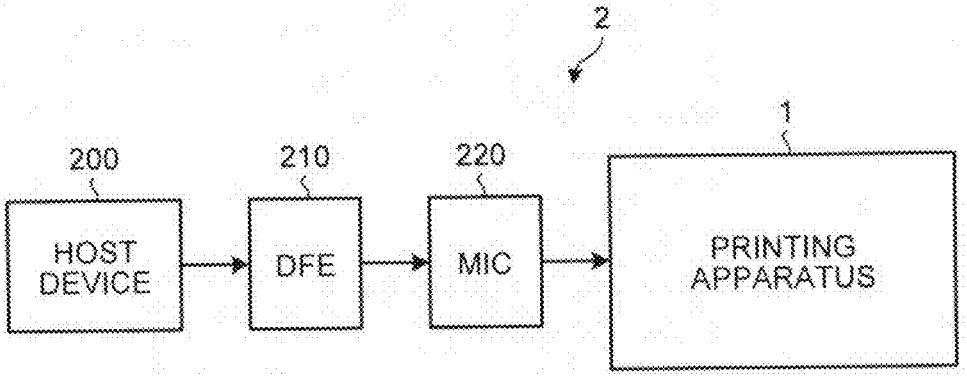
FIG. 25 is a block diagram illustrating an example of a printing system including the printing apparatus according to the embodiment.

Furthermore, the image data explained in the above embodiment may be input by, for example, an external higher-level apparatus. FIG. 25 illustrates an example of a printing system including the printing apparatus according to the embodiment. As illustrated in FIG. 25, a printing system 2 includes a host device 200, the printer controller (digital front end: DFE) 210, and an interface controller (mechanism I/F controller: MIC) 220, in addition to the printing apparatus 1.

The host device 200 generates, for example, image data of a printing object, and outputs the image data to the DFE 210. The host device 200 may be, for example, a personal computer (PC). The DFE 210 communicates with the printing apparatus 1 via the MIC 220, and controls image formation performed by the printing apparatus 1. The DFE 210 is formed of a PC for example. Furthermore, other host devices, such as PCs, may be connected to the DFE 210. The DFE 210 receives image data in a vector format from the host device 200 and performs language interpretation on the image data, to thereby convert the image data in the vector format to image data in a raster format. In this case, the DFE 210 converts a color space represented by an RGB format or the like into a color space represented by a CMYK format or the like. The DFE 210 transmits the generated image data in the raster format to the printing apparatus 1 via the MIC 220.

While an example is explained in the embodiment that the DFE 210 is formed of a single PC, the present invention is not limited to this example. For example, the DFE 210 may be incorporated into the host device 200, or may be mounted on the printing apparatus 1 together with the MIC 220. Furthermore, if the printing system 2 is configured as a cloud computing system, the DFE 210 may be installed in a computer on the network, may be disposed between the network and the printing apparatus 1, or may be installed in the printing apparatus 1.

According to an embodiment of the present invention, it is possible to provide a printing apparatus, a treatment object modifying apparatus, a printing system, and a printed material manufacturing method capable of manufacturing a high-quality printed material while preventing an increase in costs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing apparatus comprising:

a plasma treatment unit that performs plasma treatment on a surface of a treatment object to acidify at least the surface of the treatment object;

a recording unit that performs an inkjet recording process on the surface of the treatment object subjected to the plasma treatment by the plasma treatment unit; and a control unit that adjusts plasma energy for the plasma treatment according to a type of an ink used in the inkjet recording process.

2. The printing apparatus according to claim 1, further comprising:

a reading unit that reads an image that is formed on the treatment object through the inkjet recording process, wherein the control unit analyzes at least one of dot circularity, a dot diameter, and a deviation of a pigment density in the image read by the reading unit, and adjusts the plasma energy for the plasma treatment based on a result of the analysis.

3. The printing apparatus according to claim 1, further comprising:

a storage unit that stores therein an optimal value of the plasma energy for the plasma treatment in association with at least one of the type of the ink used in the inkjet recording process, a type of the treatment object, and a size of an ink droplet for a dot, wherein the control unit specifies at least one of the type of the ink used in the inkjet recording process, a size of an ink droplet used in the inkjet recording process, and the type of the treatment object, acquires the optimal value of the plasma energy from the storage unit based on at least the specified one of the type of the ink, the size of the ink droplet, and the type of the treatment object, and adjusts the plasma energy for the plasma treatment based on the acquired optimal value of the plasma energy.

4. The printing apparatus according to claim 3, wherein the storage unit stores therein the optimal value of the plasma energy in association with one of a print mode set by the recording unit and a combination of inks used in the inkjet recording process, the control unit further specifies one of the print mode and the combination of the inks, in addition to one of the type of the ink, the size of the ink droplet, and the type of the treatment object, acquires an optimal value of the plasma energy from the storage unit based on at least the specified one of the type of the ink, the size of the ink droplet, and the type of the treatment object and based on one of the print mode and the combination of the inks, and adjusts the plasma energy for the plasma treatment based on the acquired optimal value of the plasma energy.

5. The printing apparatus according to claim 2, wherein the recording unit forms a test pattern, the test pattern being prepared in advance, on the treatment object subjected to the plasma treatment, and the control unit analyzes at least one of the dot circularity, the dot diameter, and the deviation of the pigment density in the test pattern read by the reading unit.

6. The printing apparatus according to claim 5, wherein the recording unit forms the test pattern containing dots with at least two different dot diameters by using at least the ink used in the inkjet recording process.

7. The printing apparatus according to claim 3, wherein the control unit updates the storage unit with the adjusted plasma energy.

8. A treatment object modifying apparatus comprising:

a plasma-treatment performing unit that performs plasma treatment on a surface of a treatment object to acidify at least the surface of the treatment object; and a control unit that adjusts plasma energy for the plasma treatment according to a type of an ink applied to the treatment object acidified by the plasma-treatment performing unit.

9. A printing system, comprising:

the treatment object modifying apparatus of claim 8; and an inkjet recording apparatus that ejects an ink on the treatment object acidified by the plasma-treatment performing unit.

10. A printed material manufacturing method for manufacturing a printed material with an image formed through an inkjet recording process, the printed material manufacturing method comprising:

performing plasma treatment on a surface of a treatment object to acidify at least the surface of the treatment object;

performing an inkjet recording process on the surface of the treatment object subjected to the plasma treatment at the performing the plasma treatment; and adjusting plasma energy used for the plasma treatment according to a type of an ink used at the performing the inkjet recording process.

* * * * *